US011082768B2

(12) United States Patent
Ong et al.

(10) Patent No.: US 11,082,768 B2
(45) Date of Patent: Aug. 3, 2021

(54) APPARATUS WITH ACOUSTIC ENHANCEMENT AND METHOD FOR THE SAME

(71) Applicant: Creative Technology Ltd, Singapore (SG)

(72) Inventors: Kok Huan Ong, Singapore (SG); Jiaqi Wang, Singapore (SG); Wei-Peng Renny Lim, Singapore (SG)

(73) Assignee: Creative Technology Ltd, Singapore (SG)

( * ) Notice: Subject to any disclaimer, the term of this patent is extended or adjusted under 35 U.S.C. 154(b) by 0 days.

(21) Appl. No.: 16/405,404

(22) Filed: May 7, 2019

(65) Prior Publication Data

US 2020/0359126 A1 Nov. 12, 2020

(51) Int. Cl.
*H04R 1/28* (2006.01)
*H04R 1/10* (2006.01)

(52) U.S. Cl.
CPC ..... *H04R 1/28* (2013.01); *H04R 1/1083* (2013.01)

(58) Field of Classification Search
CPC ... H04R 1/28; H04R 9/02; H04R 1/10; H04R 7/04
See application file for complete search history.

(56) References Cited

U.S. PATENT DOCUMENTS

2014/0226847 A1 8/2014 Yang
2016/0192065 A1* 6/2016 Oosato ..... H04R 1/2826 381/378
2016/0295315 A1 10/2016 Kuwahara et al.
2018/0295449 A1* 10/2018 Morgan ..... H04R 1/105

* cited by examiner

*Primary Examiner* — Regina N Holder
(74) *Attorney, Agent, or Firm* — Russell Swerdon; Desmund Gean

(57) ABSTRACT

An apparatus with acoustic enhancement and corresponding frequency response is disclosed. The apparatus includes a driver with a primary bass port having a primary bass port chamber and a secondary bass port having a secondary bass port chamber. The secondary bass port can be coupled to the primary bass port at one end and have substantially unimpeded air flow at another end. The apparatus may further include an acoustic chamber that is separated or isolated from either the primary bass port chamber, secondary bass port chamber, or both primary and secondary bass port chambers. A switch may also be included to dynamically control an air flow resistor at the latter end of the secondary bass port. The primary bass port chamber, secondary bass port chamber, acoustic chamber, and the air flow resistor can separately or collectively be used for tuning the frequency response according to the acoustic enhancement desired.

22 Claims, 7 Drawing Sheets

APPARATUS WITH ACOUSTIC ENHANCEMENT AND METHOD FOR THE SAME

BACKGROUND OF THE INVENTION

1. Field of the Invention

The present invention relates to audio reproduction devices. More particularly, the present invention relates to an apparatus with acoustic enhancement and method for the same.

2. Description of the Related Art

Audio reproduction devices include headphones for audio playback. There are many headphones available for a user to choose from. Most headphones are classified with respect to their sound signatures that are fixed. However, the user may want to adjust the sound signature based on a particular situation or personal preference. Therefore, there is a need for easily adjusting the sound signature by the user.

Further, in order to achieve a particular sound signature, tuning the headphone is required. Tuning is often complicated and time consuming. As such, changing the headphone design requires very much consideration. Therefore, there is a need to make tuning more efficient.

Accordingly, it is desirable to provide at least an apparatus with acoustic enhancement and method for the same to address the above needs.

SUMMARY OF THE INVENTION

In one aspect of the invention, an apparatus with acoustic enhancement is provided. The apparatus has a corresponding frequency response and includes: 1) a driver unit with a housing having an interior side for integrating together a magnet, a diaphragm, and a primary bass port, the primary bass port being substantially surrounded by the magnet and having a primary bass port chamber with a first end opening facing towards the diaphragm and a second end opening facing opposite of the first end opening, the diaphragm being located on a front side of the driver unit and configured for analog audio reproduction; and 2) a secondary bass port having a secondary bass port chamber with a third end opening and a fourth end opening, the secondary bass port being coupled at the third end opening to the primary bass port at the second end opening, and the fourth end opening having substantially unimpeded air flow.

In some embodiments, the apparatus further includes an acoustic chamber configured to prevent ambient noise from substantially mixing with the analog audio reproduction. The acoustic chamber substantially encircles and covers a backside of the driver unit except for where the secondary bass port couples to the primary bass port of the driver. The acoustic chamber and the secondary bass port are configured for collectively tuning the sound pressure levels in the frequency response and the backside of the driver unit corresponds to an exterior side of the housing. The exterior side of the housing is opposite of the interior side of the housing and the second end opening of the primary bass port does not open to the acoustic chamber. Each chamber has a different pressure during an operational mode. The operational mode is when the diaphragm is moving.

Yet, in some embodiments, a first air flow resistor is controllable to apply different air flow resistances at the fourth end opening of the secondary bass port; a second air flow resistor is configured to apply a fixed air flow resistance at either the second end opening of the primary bass port or third end opening of the secondary bass port; the first and second air flow resistors are of a gas permeable construction; the gas permeable construction including paper, cloth, foam, mesh, or felt; or application of different air flow resistances at the fourth end opening of the secondary bass port results in different sound pressure levels within a frequency range of about 20 Hz to 1.5 kHz in the frequency response. Some embodiments have the apparatus further include a user switch for controlling in real time the first air flow resistor's application of different air flow resistances at the fourth end opening of the secondary bass port, the different air flow resistances being incremental or continuous values.

Yet, in some embodiments, the secondary bass port is sizable in real time; the secondary bass port is configured for tuning the sound pressure levels in the frequency response; the secondary bass port is configured for tuning the sound pressure levels within a frequency range of about 100 Hz to 4 kHz in the frequency response; or the secondary bass port chamber has a corresponding air flow resistance such that lowering the air flow resistance results in increasing sound pressure levels between about 100 Hz and 300 Hz in the frequency response for worse vocal clarity and increasing the air flow resistance results in decreasing sound pressure levels between about 100 Hz and 300 Hz in the frequency response for better vocal clarity.

Yet, in some embodiments, the secondary bass port include multiple sections that divide the secondary bass port chamber into sub-chambers, each sub-chamber having a different cross sectional area; at least two of the multiple sections are constructed from different materials, the material including plastic, ethylene-vinyl acetate (EVA) felt, metal, non-metal, rubber, foam, or sponge; the driver unit is a dynamic driver; the apparatus including in-ear headphones, on-ear headphones, over-ear headphones, open-back headphones, semi-open back headphones, or closed-back headphones; or the primary bass port is a substantially straight tube and the secondary bass port is a hollow structure of substantially any shape including a straight tube, a winding tube, a straight/winding polygonal cross sectional hollow structure, a straight/winding cylindrical hollow structure, a flare out tube, or any combination of these.

In another aspect of the invention, an apparatus with acoustic enhancement is provided. The apparatus has a corresponding frequency response and includes: 1) means for converting electrical audio input signal to acoustical audio output signal; and 2) means for tuning the sound pressure levels within a frequency range of about 100 Hz to 4 kHz in the frequency response and for coupling the tuning means to the converting means.

In yet another aspect of the present invention, a method for an apparatus with acoustic enhancement is provided. The apparatus has a corresponding frequency response. The method includes: 1) providing a driver unit with a housing having an interior side for integrating together a magnet, a diaphragm, and a primary bass port, the primary bass port being substantially surrounded by the magnet and having a primary bass port chamber with a first end opening facing towards the diaphragm and a second end opening facing opposite of the first end opening, the diaphragm being located on a front side of the driver unit and configured for analog audio reproduction; and 2) providing a secondary bass port having a secondary bass port chamber with a third end opening and a fourth end opening, the secondary bass port being coupled at the third end opening to the primary bass port at the second end opening, and the fourth end opening having substantially unimpeded air flow.

Some of the advantages of the present invention include: 1) efficient tuning of a sound producing apparatus' sound signature; 2) easy adjustability/customization/configuration of the sound producing apparatus' sound signature; 3) easy adaptability to different sound producing apparatus' hardware configurations; 4) cost savings. These and other features and advantages of the present invention are described below with reference to the drawings.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

An apparatus with acoustic enhancement and corresponding frequency response is disclosed. The apparatus includes a driver with a primary bass port having a primary bass port chamber and a secondary bass port having a secondary bass port chamber. The secondary bass port can be coupled to the primary bass port at one end and have substantially unimpeded air flow at another end. The apparatus may further include an acoustic chamber that is separated or isolated from either the primary bass port chamber, secondary bass port chamber, or both primary and secondary bass port chambers. A switch may also be included to dynamically control an air flow resistor at the latter end of the secondary bass port. The primary bass port chamber, secondary bass port chamber, acoustic chamber, and the air flow resistor can separately or collectively be used for tuning the frequency response according to the acoustic enhancement desired. The apparatus may be any device suitable for implementing the present invention such as an audio reproduction device that includes, but is not limited to, a headphone and a loudspeaker.

Figure 1:
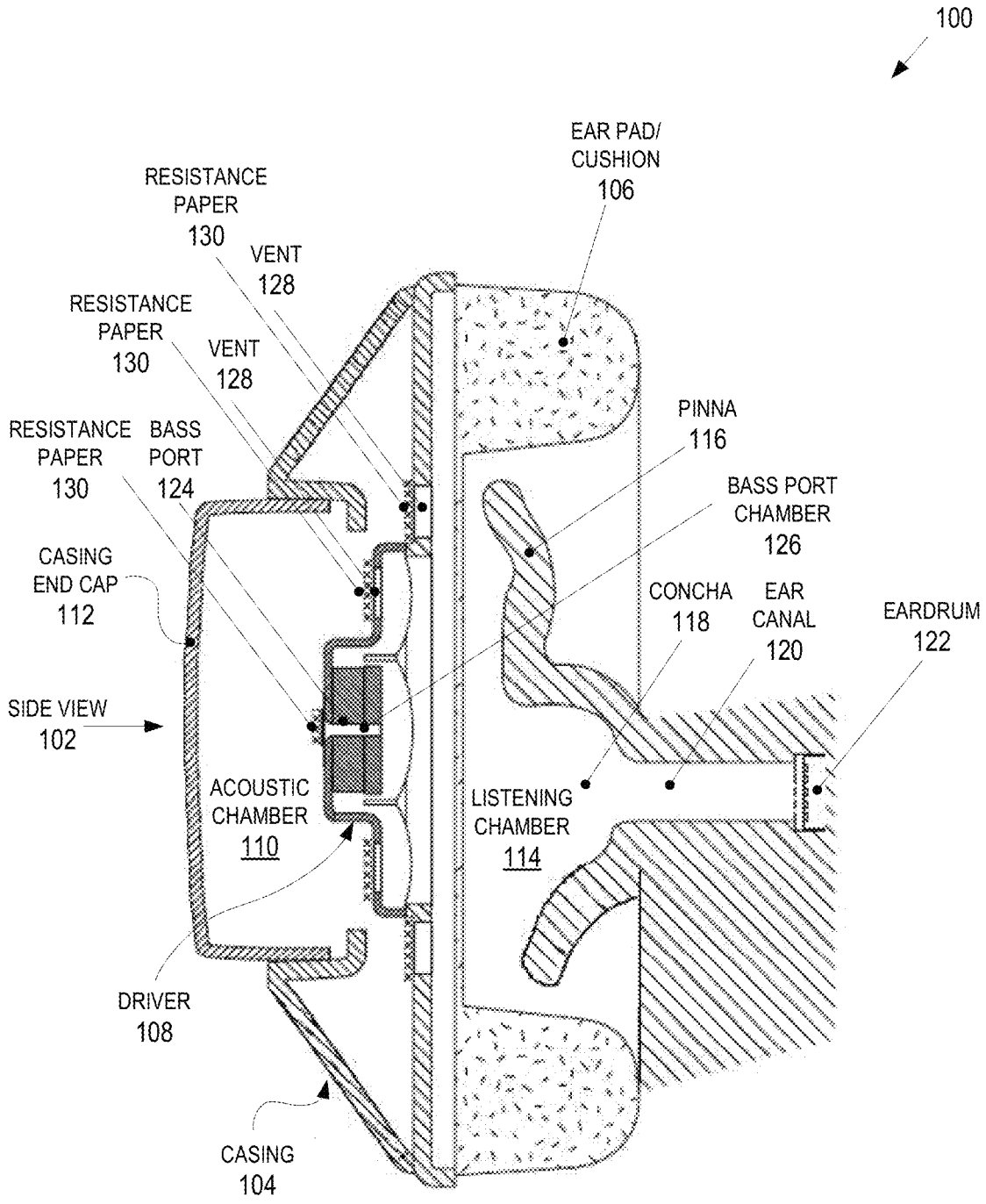
(PRIOR ART) FIG. 1
FIG. 1 is a front view cross-section of a conventional headphone.

FIG. 1 is a front view cross-section of a conventional headphone 100. The components of headphone 100 that are shown in the front view cross-section (i.e., the view of the headphone as worn by a user facing outward) are typically symmetrical and/or round in shape from a side view perspective 102. Headphone 100 may be any type of headphone including but not limited to on-ear, over-the-ear, and in-ear headphones. As shown, headphone 100 is an over-the-ear type headphone that includes a casing 104 and an ear pad/cushion 106 attached thereon. Casing 104 houses a driver 108, an acoustic chamber 110, and optionally (not shown) a printed circuit board assembly (e.g., PCBA for digital signal processing) and battery (e.g., for powering PCBA or driver) within acoustic chamber 110. Ear pad/cushion 106 is configured to seal against a user's head and around the user's ear when headphone 100 is worn by the user. Ear pad/cushion 106 may be constructed with any pliable material such as foam, rubber, or sponge. Casing 104 includes a casing end cap 112 that is removable such that access to the interior and interior components (e.g., PCBA, battery, driver, etc.) of casing 104 is possible. Casing 104 may be constructed with any material including but not limited to plastic, metal, non-metals, or any combination of them.

When headphone 100 is under an operation mode, acoustical audio output signals are generated by driver 108 from electrical audio input signals and projected into a listening chamber 114 formed by some combination of casing 104, ear pad/cushion 106, driver 108, the user's head, and the user's ear (including pinna 116, concha 118, ear canal 120, eardrum 122). Chambers are typically void spaces with specific pressures when the headphone is under the operation mode such as when the driver is generating acoustical audio output signals from electrical audio input signals. The generation of acoustical audio output signals generally coincides with the movement of the driver's diaphragm whereby acoustical audio output signals propagate from driver 108 (via diaphragm) into listening chamber 114 and are received by eardrum 122 for user interpretation and listening enjoyment.

Headphones can be defined by their sound signatures, which are related to their frequency response. Tuning the frequency response can be a complicated and time consuming process where consideration must be given to different variables of the headphone design such as the kind of materials used in its construction, the volume and pressure in the chambers in the casing (e.g. acoustic chamber 110, bass port chamber 126) and listening chamber 114, the size and number of vent holes 128, the type of resistance paper 130 used at vent holes 128 or bass port 124 (may also be called dome vent), whether the headphone is open back or closed back type, and driver 108 specification. Therefore, it would be beneficial to simplify the tuning process in order to save time and resources.

Figure 2:
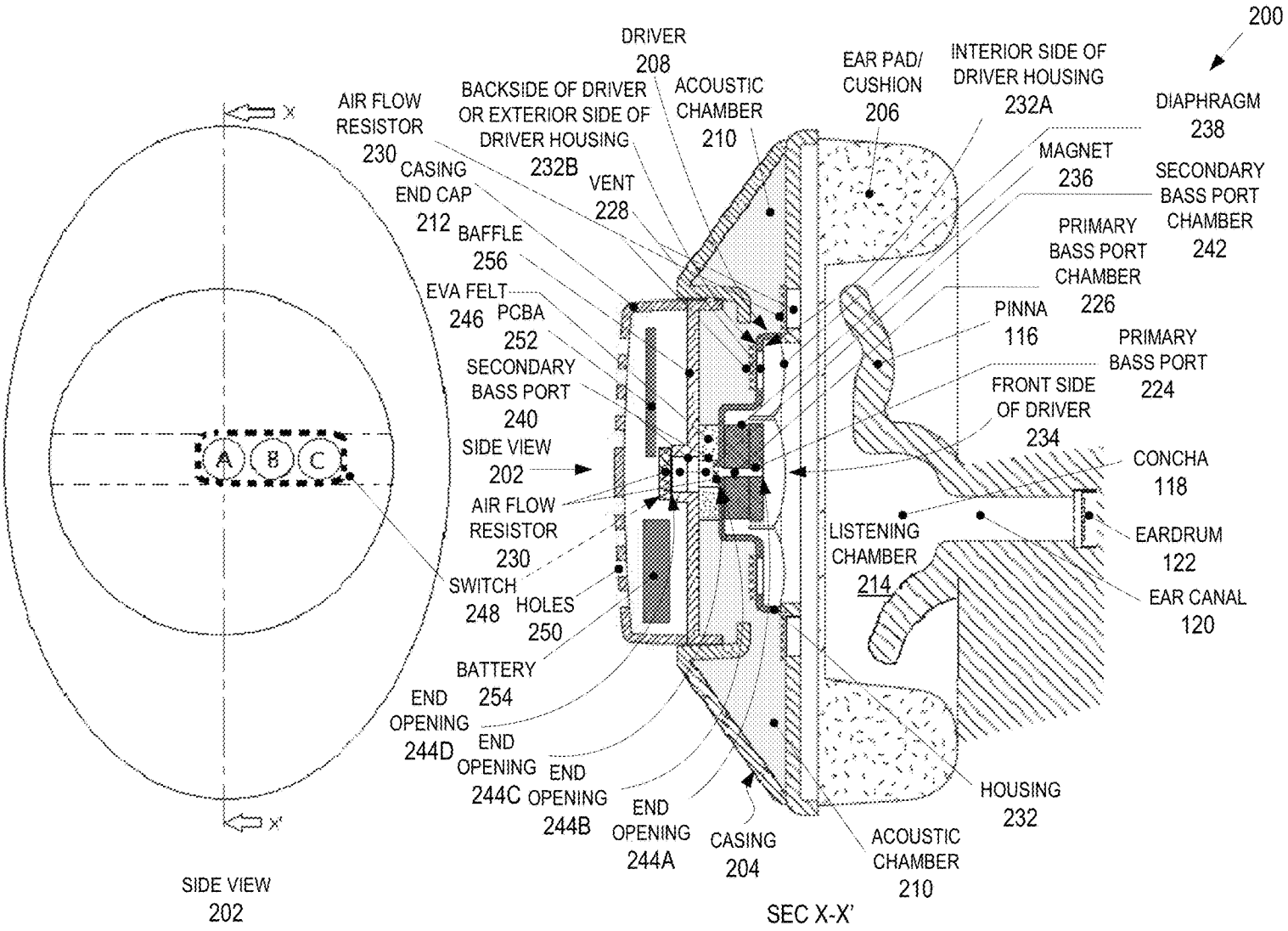
FIG. 2 is a front view cross-section of a headphone with acoustic enhancement based on a (relatively shorter) secondary bass port according to various embodiments of the present invention.

FIG. 2 is a front view cross-section of a headphone 200 with acoustic enhancement based on a secondary bass port 240 according to various embodiments of the present invention. The components of headphone 200 that are shown in the front view cross-section (i.e., the view of the headphone as worn by a user facing outward) are typically symmetrical and/or round in shape from a side view perspective 202. Headphone 200 may be any type of headphone including but not limited to on-ear, over-the-ear, in-ear, closed-back, semi-open back, and open-back headphones. As shown, headphone 200 is an over-the-ear type headphone that includes a casing 204 and an ear pad/cushion 206 attached thereon. Casing 204 is configured to house a driver 208, an acoustic chamber 210, and optionally a printed circuit board assembly 252 (e.g., PCBA for digital signal processing) and battery 254 (e.g., for powering PCBA 252 or driver 208) in chamber(s) separate from acoustic chamber 210. In general, driver 208 is a dynamic driver.

Ear pad/cushion 206 is generally configured to seal against a user's head and around the user's ear when headphone 200 is worn by the user. Ear pad/cushion 206 may be constructed with any pliable material such as foam, rubber, sponge, or any suitable material known by those skilled in the art. Casing 204 may or may not include a casing end cap 212 (also called back cap) that could be non-removable or removable such that access to the interior and interior components (e.g., driver 208, etc.) of casing 204 is possible. Casing 204 may have rigid portions and/or flexible portions and be constructed with any material including but not limited to plastic, metal, non-metal, rubber, or any combination of them. Casing end cap 212 may integrate within or complement separately other headphone 300 components (e.g., baffle 256, secondary bass port 240). For example, casing end cap 212 may be constructed together with baffle 256 and secondary bass port 240 or constructed separately for attachment over baffle 256 and secondary bass port 240.

When headphone 200 is under an operation mode, acoustical audio output signals are generated by driver 208 from electrical audio input signals and projected into a listening chamber 214 formed by some combination of casing 204, ear pad/cushion 206, driver 208, the user's head, and the user's ear (including pinna 116, concha 118, ear canal 120, eardrum 122). Chambers are typically void spaces with specific pressures or differential pressures when headphone 200 is under the operation mode such as when driver 208 is generating acoustical audio output signals from electrical audio input signals. As such, each chamber may have a different pressure or differential pressure during an operational mode. The generation of acoustical audio output signals generally coincides with the movement of the driver's diaphragm 238 whereby acoustical audio output signals propagate from driver 208 (via diaphragm 238) into listening chamber 214 and are received by eardrum 122 for user interpretation and listening enjoyment.

According to various embodiments, headphone 200 is provided with acoustic enhancements and a corresponding frequency response. To elaborate, headphone 200 includes driver 208 with a housing 232 having an interior side 232A for integrating together a magnet 236, diaphragm 238, and a primary bass port 224. Primary bass port 224 is substantially surrounded/encircled by magnet 236 and has a primary bass port chamber 226 with a first end opening 244A facing towards diaphragm 238 and a second end opening 244B facing opposite of first end opening 244A. Diaphragm 238 is located on a front side 234 of driver 208 and configured for analog audio reproduction. In addition, headphone 200 includes secondary bass port 240 having a secondary bass port chamber 242 with a third end opening 244C and a fourth end opening 244D. Secondary bass port 240 is coupled at third end opening 244C to primary bass port 224 at second end opening 244B. Fourth end opening 244D has substantially unimpeded air flow.

Generally, secondary bass port 240 is a hollow structure of substantially any shape such as a straight tube, a winding tube, a straight/winding polygonal cross sectional hollow structure, a straight/winding cylindrical hollow structure, a flare out tube, or any combination of these shapes. Secondary bass port 240 may include multiple sections that divide secondary bass port chamber 242 into sub-chambers. Each sub-chamber may have a different cross sectional area. The multiple sections may be constructed from different materials such as plastic, ethylene-vinyl acetate (EVA) felt 246, metal, non-metal, rubber, foam, or sponge. Further, secondary bass port 240 may be separate from or integrated with baffle 256, which could be used to form part of acoustic chamber 210. Although primary bass port 224 is substantially a straight tube, it may also share some of the aforementioned characteristics of secondary bass port 240.

According to a preferred embodiment, secondary bass port 240 is configured for tuning the sound pressure levels in the frequency response. Specifically, secondary bass port 240 is configured for tuning the sound pressure levels within a frequency range of about 100 Hz to 4 kHz in the frequency response. Further, secondary bass port chamber 242 has a corresponding air flow resistance such that lowering the air flow resistance results in increasing sound pressure levels between about 100 Hz and 300 Hz in the frequency response for worse vocal clarity and increasing the air flow resistance results in decreasing sound pressure levels between about 100 Hz and 300 Hz in the frequency response for better vocal clarity. Further details will be provided in FIG. 6.

Acoustic chamber 210 is configured to prevent ambient noise from substantially mixing with the analog audio reproduction. Acoustic chamber 210 substantially surrounds/encircles and covers a backside 232B of driver 208 except for where secondary bass port 240 couples to primary bass port 224 of driver 208. Backside 232B of driver 208 corresponds to an exterior side 232B of housing 232, which is opposite of interior side 232A of housing 232. In a preferred embodiment, second end opening 244B of primary bass port 224 does not open to acoustic chamber 210. Acoustic chamber 210 and secondary bass port 240 are configured for separately or collectively tuning the sound pressure levels in the frequency response. Advantageously, acoustic chamber 210 can effectively be an isolation chamber where outside noise does not get in (or substantially prevented from getting in) and sound inside headphone 200 does not get out (or substantially prevented from getting out). It should be noted, however, that acoustic chamber 210 can be optional in headphone 200 and that aspects of the present invention can be implemented without acoustic chamber 210.

Acoustic chamber 210 may also use vent holes 228 to balance the air pressure in listening chamber 214 and to modulate/regulate diaphragm 238. Vent holes 228 allow air to leak between acoustic chamber 210 and diaphragm 238 in order to maintain the proper tension of diaphragm 238. As such, acoustic chamber 210 may function to modulate/regulate diaphragm 238.

Headphone 200 may also include air flow resistors 230. For example, a first air flow resistor 230 is controllable to apply different/variable air flow resistances at fourth end opening 244D of secondary bass port 240. A second air flow resistor 230 is configured to apply an air flow resistance at either second end opening 244B of primary bass port 224 or third end opening 244C of secondary bass port 240. First and second air flow resistors 230 may be of a gas permeable construction such as damping material, paper, cloth, foam, mesh, and felt. In general, air flow resistor 230 may be used to adjust the bass levels in the frequency response. Therefore, air flow resistor 230 may be of any number, thickness, or type. Headphone 200 may also exclude air flow resistors 230. For example, there could be differential pressure between port end openings due to Helmholtz resonance (port resonance) where it is possible to have no air flow resistors 230 at end openings of primary bass port 224 and secondary bass port 240.

Headphone 200 may further include a user switch 248 for controlling in real time first air flow resistor's 230 application of different air flow resistances at fourth end opening 244D of secondary bass port 240. Generally, the smaller the air flow resistance, the stronger the bass level in the frequency response. The different air flow resistances can be adjusted incrementally over group of values or continuously in sequential values. User switch 248 may be any suitable controller for adjusting the air flow resistance at fourth end opening 244D. It may be implemented locally (e.g., on the headphone) or remotely (e.g., smartphone), mechanically or electrically, servo based or non-servo based, discrete selection (e.g., pushbuttons) or continuous selection (e.g., slider), or using any combination of these techniques. By applying different air flow resistances at fourth end opening 244D of secondary bass port 240, different corresponding sound pressure levels within a frequency range of about 20 Hz to 1.5 kHz in the frequency response can be achieved.

Open back type headphones generally do not have a restrictive barrier for sealing in the audio playback and keeping out ambient noise from penetrating the user's listening experience. On the other hand, closed back type headphones generally have a restrictive barrier for sealing in the audio playback while keeping out ambient noise from penetrating the user's listening experience. For example, a closed back type headphone may have its ear pad covered by a shell that houses the driver and hinders the transmission of sound through it. As such, headphone 200 can be viewed as a hybrid between an open back type headphone (for having holes 250 in casing end cap 212 or secondary bass port 240 open to free air) and a closed back type headphone (for having acoustic chamber 210 substantially covering driver 208). Although secondary bass port 240 may open to free air with or without air flow resistor 230 (e.g., via holes 250 in casing end cap 212 or directly for the purpose of achieving the desired tuning of the headphone's frequency response), the sound escaping from secondary bass port 240 can be or in fact be negligible (e.g., due to the level or frequency range of sound escaping that can be detected by another person) such that headphone 200 may beneficially and effectively function in terms of noise isolation as a closed back type headphone even though it may be an open back type headphone. In some embodiments, headphone 200 is a semi-open back type headphone that allows for some sound isolation and a little sound leakage.

As noted earlier, headphones can be defined by their sound signatures, which are related to their frequency response. Tuning the frequency response can be a complicated and time consuming process where consideration must be given to different variables of the headphone. Therefore, it would be beneficial if tuning the frequency response can be limited to fewer considerations or variables. The more variables that can stay constant and/or predictable, the less complicated is the tuning of the frequency response. This is especially true in cases where different design versions of headphones are developed and the constant or predictable variable contributes a known value to the frequency response and hence the sound signature. For example, in contrast to conventional headphone 100, which includes acoustic chamber 110 designed to accommodate other components such as a PCBA or battery, acoustic chamber 210 is designed to be standalone/isolated where its volume would remain constant (note: PCBA 252 and battery 254 are housed separately from acoustic chamber 210) and not be affected by accommodating other components within it. This is especially significant if the PCBA or battery size changes after the headphone design has already been fixed or set. As such, acoustic chamber 210 allows the flexibility to change the PCBA or battery without affecting its volume, but keep its contribution to the frequency response and sound signature relatively constant or known. Further, acoustic chamber 210 allows for the independent tuning of secondary bass port (e.g., adjusting the length and/or applying air flow resistance at end openings without needing to also tuning/retuning acoustic chamber 210) for bass or vocal enhancement in the headphone's frequency response.

Figure 3:
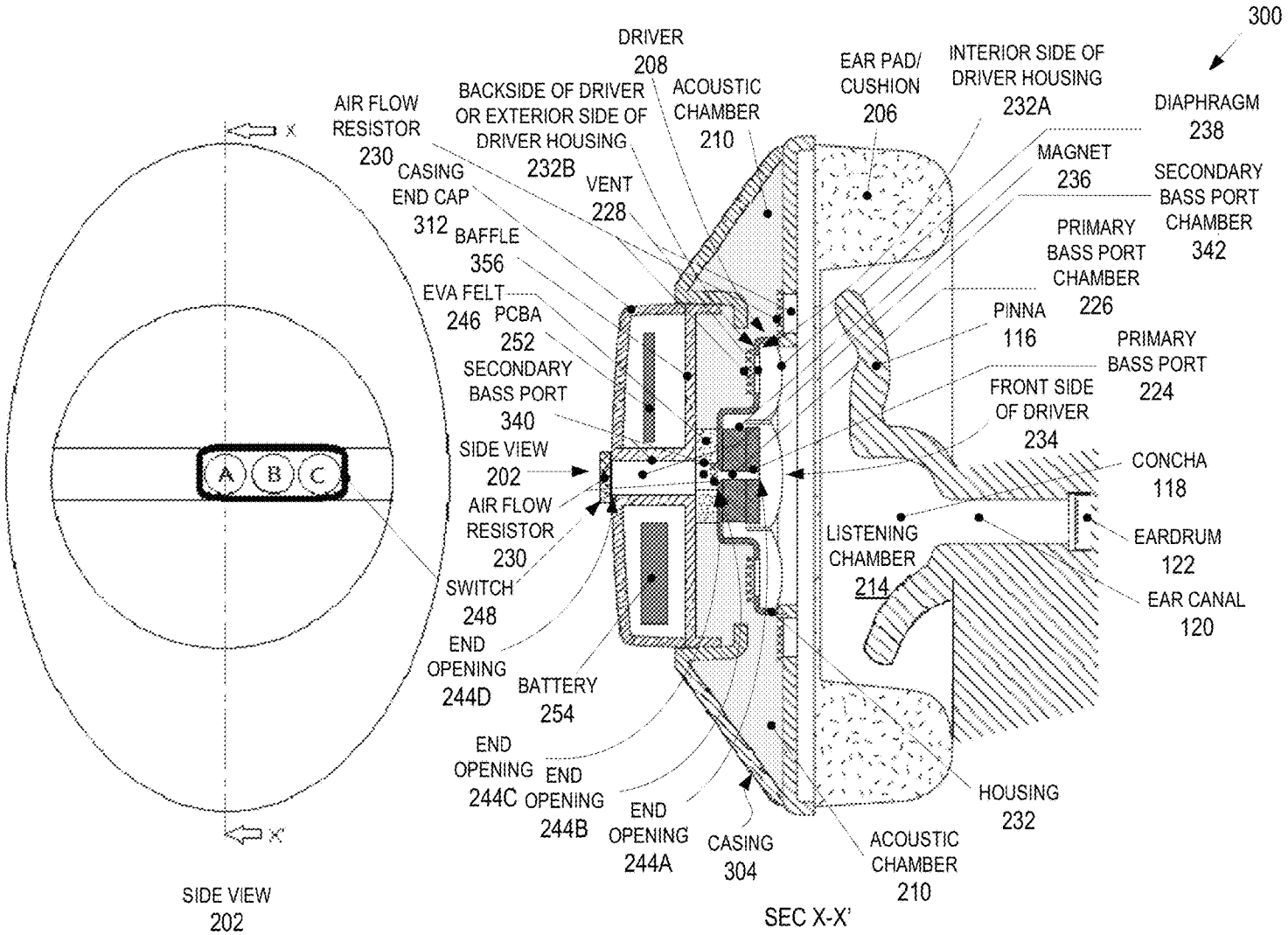
FIG. 3 is a front view cross-section of a headphone with acoustic enhancement based on a (relatively longer) secondary bass port according to various embodiments of the present invention.

FIG. 3 is a front view cross-section of a headphone 300 with acoustic enhancement based on a secondary bass port 340 according to various embodiments of the present invention. Headphone 300 is similar to headphone 200 except for a few differences. As such, many aspects and benefits of headphone 200 apply to headphone 300. However, one of the main differences is that headphone 300 includes a casing 304 with secondary bass port 340 that is relatively longer than secondary bass port 240 in headphone 200. Despite these differences, secondary bass ports 240 and 340 still share similar aspects. For example, the materials to construct them can be the same.

The size of secondary bass port 340 can be fixed or adjusted in advance or in real time to achieve the desired frequency response. Adjustments may be made with a sizable secondary bass port 340. For example, secondary bass port 340 may be sizable with a collapsible tube and/or expandable tube. Secondary bass port 340 may be sizable by adjusting any of its physical dimensions (e.g., diameter, length, height, width, etc.). Adjustments can be implemented via local control (e.g., on the headphone) or remote control (e.g., smartphone), mechanical or electrical systems, servo based or non-servo based systems, discrete selection (e.g., pushbuttons) or continuous selection (e.g., slider), or via any combination of these techniques. Adjustments may be done with a user switch similar to user switch 248. A longer secondary bass port 340 than as shown in FIG. 3 can also be integrated into casing 304, especially in casing end cap 312. For instance, secondary bass port 340 can be expanded in length by winding/coiling inside casing end cap 312 before having fourth end opening 244D open to air.

Similar to casing end cap 212, casing end cap 312 may integrate within or complement separately other headphone 300 components (e.g., baffle 356, secondary bass port 340). For example, casing end cap 312 may be constructed together with baffle 356 and secondary bass port 340 or constructed separately for attachment over baffle 356 and secondary bass port 340. Further, secondary bass port 340 may be separate from or integrated with baffle 356, which could be used to form part of acoustic chamber 210.

Due to the relatively longer secondary bass port 340 than secondary bass port 240, corresponding secondary bass port chamber 342 is relatively longer than secondary bass port chamber 242. As such, a larger volume of secondary bass port chamber 342 or larger corresponding air flow resistance can result in a frequency response for headphone 300 that is different from headphone 200. According to a preferred embodiment, secondary bass port 340 is configured for tuning the sound pressure levels in the frequency response. Specifically, secondary bass port 340 is configured for tuning the sound pressure levels within a frequency range of about 100 Hz to 4 kHz in the frequency response. Further, secondary bass port chamber 342 has a corresponding air flow resistance such that lowering the air flow resistance results in increasing sound pressure levels between about 100 Hz and 300 Hz in the frequency response for worse vocal clarity and increasing the air flow resistance results in decreasing sound pressure levels between about 100 Hz and 300 Hz in the frequency response for better vocal clarity. Further details will be provided in FIG. 6.

By being able to adjust or configure the sound pressure levels in the frequency response, secondary bass port 340 and/or secondary bass port chamber 342 can compensate for sound pressure levels that would otherwise be contributed from other headphone components (e.g., acoustic chamber 110). Therefore, the other headphone components can be minimized and the overall headphone size reduced. For example, conventional acoustic chamber 110 requires a larger volume and size for a larger bass level. However, if conventional acoustic chamber 110 is reduced in volume and size for a smaller headphone, the bass level is correspondingly reduced. Accordingly, the present invention is advantageously able to generate the larger bass level even for a smaller headphone with the implementation of acoustic chamber 210 of smaller volume and size, secondary bass port 240/340, and secondary bass port chamber 242/342.

Due to secondary bass port 340 extending through casing end cap 312, casing 304 includes casing end cap 312 with optional chamber(s) for housing PCBA 252 and battery 254. The chamber(s) are configured to integrate into casing end cap 312 such that the walls that form the chamber(s) may also be used to form a portion of secondary bass port 340 and/or baffle 356. As shown, only a single chamber houses PCBA 252 and battery 254 where the inner wall forms the cylindrical shape of secondary bass port 340. Further, EVA felt 246 forms another portion of the cylindrical shape of secondary bass port 340 and connects to primary bass port 224. EVA felt 246 also provides advantageous sealing properties.

The present invention's ability to tune the frequency response by adjusting the size (e.g., length, diameter, width, height, etc.) of secondary bass port 240/340 and/or applying air flow resistances at end openings of secondary bass port 240/340 allows for large tuning adjustments as well as large incremental tuning adjustments; thereby, making large tuning adjustments more efficient. In contrast, traditional headphone 100 only allows for small tuning adjustments as well as small incremental tuning adjustments. However, the present invention is configurable to also make small tuning adjustments as well as small incremental tuning adjustments; thereby, making overall tuning more efficient. Adjusting a dimension of the size may compensate for another dimension of the size towards its contribution to the acoustic enhancement. For example, an increased diameter can be used in place of a decreased length and vice versa for adjusting the frequency response.

Since there are different components in headphone 200 and 300, various techniques may be used to combine them together to allow for efficient assembly or disassembly. For example, adhesives or friction tape may be used to connect different components together. Any suitable method may be used to combine the different components in headphone 200 and 300 to implement the present invention.

Figure 4:
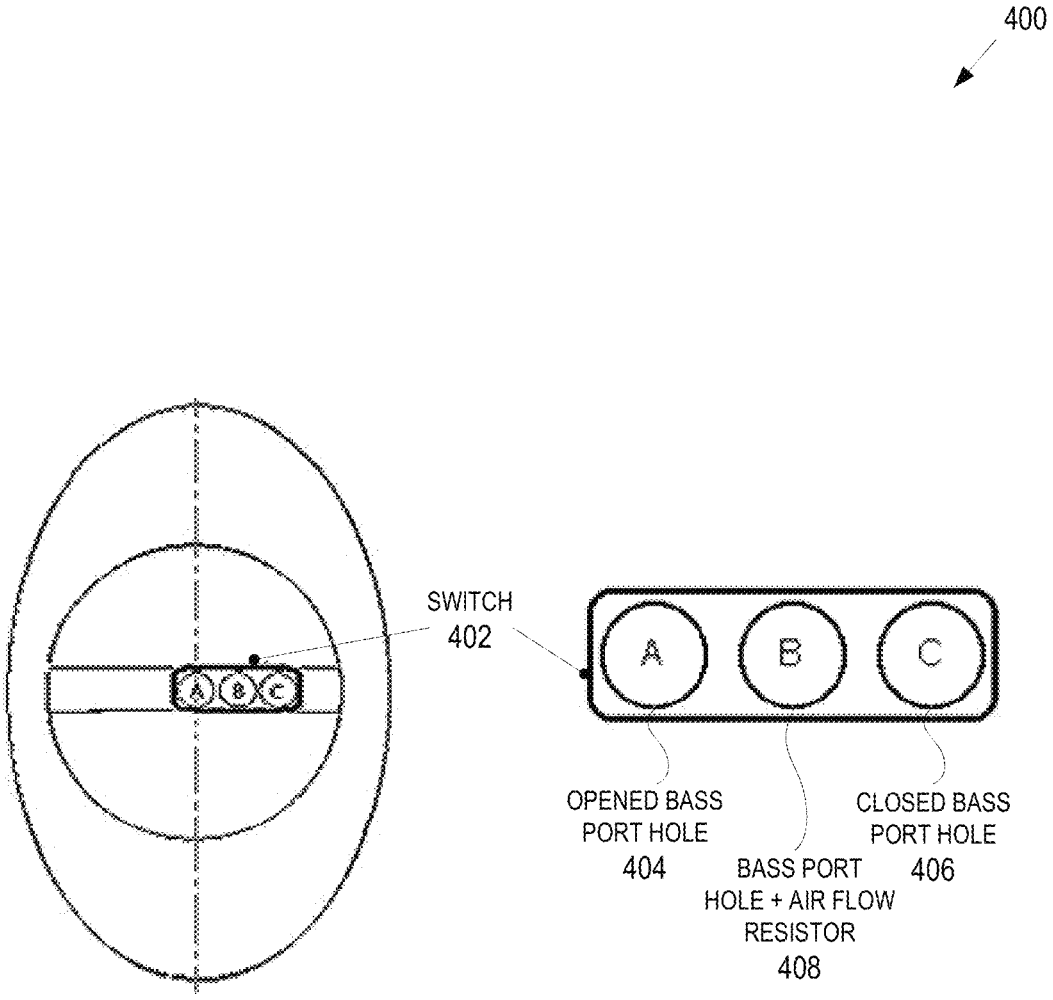
FIG. 4 is an illustration of a user switch for controlling air flow resistance at a secondary bass port according to various embodiments of the present invention.

FIG. 4 is an illustration 400 of a user switch 402 for controlling air flow resistance at a secondary bass port (e.g., 240, 340) according to various embodiments of the present invention. User switch 402 (e.g., 248) may be any suitable controller for adjusting in real time the air flow resistance at fourth end opening 244D and/or other end openings (e.g., 244B, 244C). Different air flow resistances can be adjusted incrementally over group of values or continuously in sequential values. It may be implemented locally (e.g., on the headphone) or remotely (e.g., smartphone), mechanically or electrically, servo based or non-servo based, discrete selection (e.g., pushbuttons, toggle buttons, etc.) or continuous selection (e.g., slider), voice activated or non-voice activated, contact or non-contact controls, or using any combination of these techniques. By applying different air flow resistances at end openings (e.g., at fourth end opening 244D of secondary bass port 240, 340), different corresponding sound pressure levels within a frequency range (e.g., about 20 Hz to 1.5 kHz) in the frequency response can be achieved as discussed below with reference to FIG. 5.

As shown, user switch 402 corresponds to three discrete selections, which are implemented by selection buttons A, B, and C. Selection button A corresponds to an opened bass port hole 404 (e.g., when no air flow resistance is applied at fourth end opening 244D of secondary bass port 240, 340). Selection button C corresponds to a closed bass port hole 406 (e.g., when maximum air flow resistance is applied at fourth end opening 244D of secondary bass port 240, 340). Selection button B corresponds to a bass port hole with air flow resistor applied 408 (e.g., when any degree of air flow resistance is applied at fourth end opening 244D via air flow resistor 230 of secondary bass port 240, 340). However, it should be noted that the present invention covers any number of selection buttons corresponding to any number/level of air flow resistance applications/implementations.

Air flow resistance maybe applied via one or more air flow resistor 230. Air flow resistor 230 may be any mechanism suitable for applying a corresponding resistance to air flow. Air flow resistor 230 can be of a gas permeable construction (e.g., paper, cloth, foam, mesh, felt, and etc.) or a gas non-permeable construction (e.g., plastic, metal, and etc.). As such, a gas permeable or non-permeable constructed air flow resistor 230 can be configured to incrementally cover an end opening (e.g., 244C, 244D) in secondary bass port 240, 340 such that the end opening is closed in an incremental manner to achieve an incremental air flow resistance application. Alternatively, a gas permeable or non-permeable constructed air flow resistor 230 can be configured to continuously cover an end opening in secondary bass port 240, 340 such that the end opening is closed in a continual manner to achieve any air flow resistance application. Therefore, the present invention covers different configurations for controlling and applying air flow resistance at the end opening(s).

In a preferred embodiment, a first air flow resistor 230 is controllable to apply different air flow resistances at fourth end opening 244D of secondary bass port 240, 340. A second air flow resistor 230 is configured to apply a fixed air flow resistance at either second end opening 244B of primary bass port 224 or third end opening 244C of secondary bass port 240, 340. Further, first and second air flow resistors are of a gas permeable construction such as paper, cloth, foam, mesh, and felt.

Figure 5:
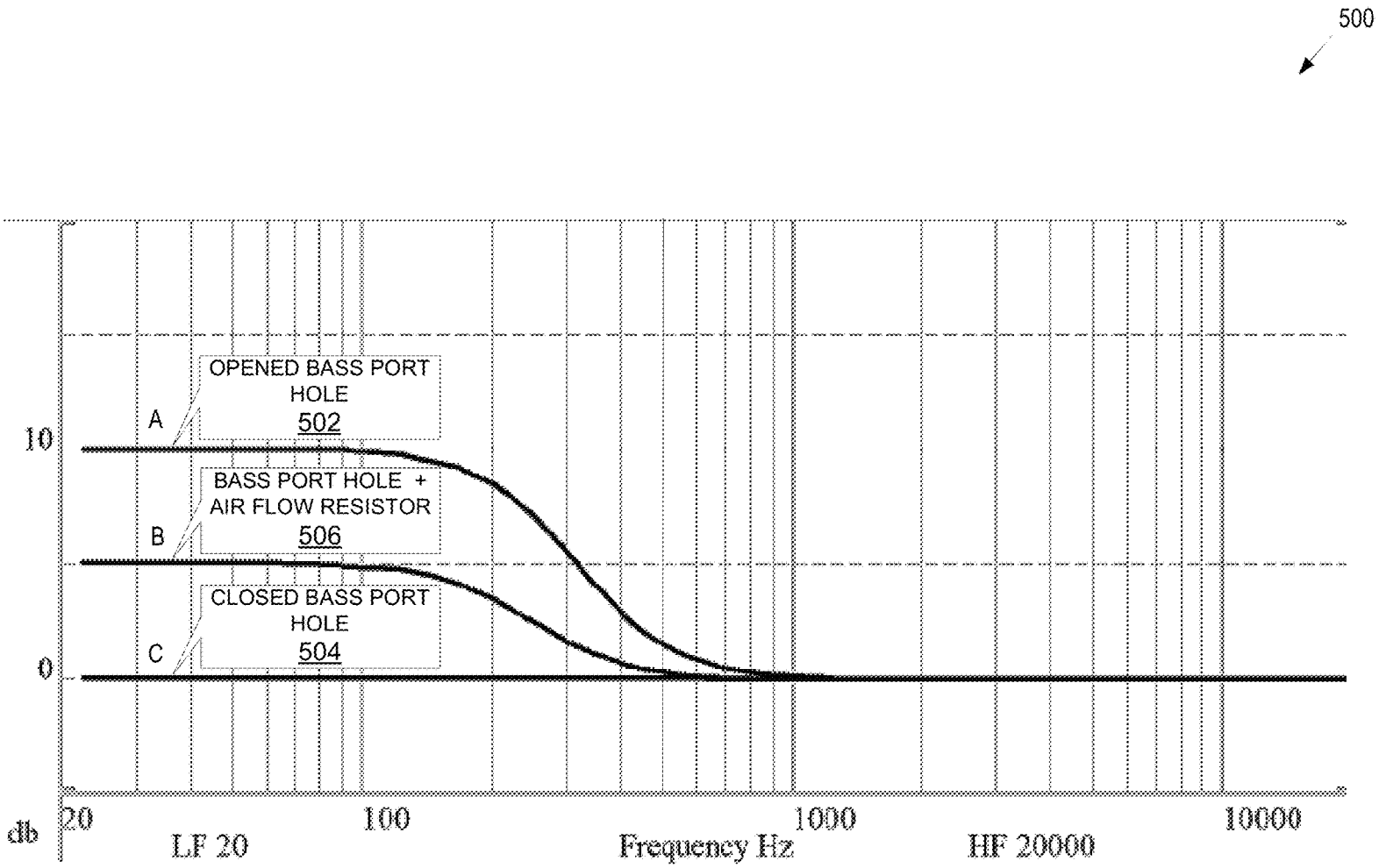
FIG. 5 is a diagram showing sound pressure levels based on varying air flow resistance at a secondary bass port end opening according to various embodiments of the present invention.

FIG. 5 is a diagram 500 showing sound pressure levels based on varying air flow resistance at a secondary bass port end opening according to various embodiments of the present invention. Diagram 500 shows a sound pressure level (dB) vs. frequency (Hz) plot based on varying air flow resistance at a secondary bass port end opening. The plot is illustrative but not exhaustive. The effect of vary air flow resistance at a secondary bass port end opening is shown in diagram 500. Specifically, by applying different air flow resistances at end openings of secondary bass port 240, 340, different corresponding sound pressure levels within a frequency range in the frequency response can be achieved.

In a preferred embodiment, different air flow resistances at fourth end opening 244D of secondary bass port 240, 340 cause an adjustment to sound pressure levels within a range of about 20 Hz to 1.5 kHz in the frequency response of headphone 200, 300. Plot curve 502 corresponds to selection button A of an opened bass port hole 404 (e.g., when no air flow resistance is applied at fourth end opening 244D of secondary bass port 240, 340) in FIG. 4. Plot curve 504 corresponds to selection button C of a closed bass port hole 406 (e.g., when maximum air flow resistance is applied at fourth end opening 244D of secondary bass port 240, 340) in FIG. 4. Plot curve 506 corresponds to selection button B of a bass port hole with air flow resistor applied 408 (e.g., when any degree of air flow resistance is applied at fourth end opening 244D via air flow resistor 230 of secondary bass port 240, 340) in FIG. 4.

Notably, plot curve 502 shows the most increase (e.g., 10 dB) to sound pressure levels within a range of about 20 Hz to 1.5 kHz in the frequency response of headphone 200, 300. Plot curve 504 shows the least increase (e.g., none) to sound pressure levels within a range of about 20 Hz to 1.5 kHz in the frequency response of headphone 200, 300. Yet, plot curve 506 shows an increase (e.g., 5 dB) to sound pressure levels within a range of about 20 Hz to 1.5 kHz in the frequency response of headphone 200, 300 that is between plot curves 502 and 504. According to various embodiments, plot curves 502, 504, and 506 can correspond to any adjustment to sound pressure levels within a range of frequencies in the frequency response of headphone 200, 300 based on the amount of air flow resistance introduced at end openings of secondary bass port 240, 340. As noted earlier, the plot is illustrative but not exhaustive. Therefore, the increase to sound pressure levels may be higher than what is shown in the plot (e.g., 20 dB instead of 10 dB for plot cure 502; 10 dB instead of 5 dB for plot cure 506).

Figure 6:
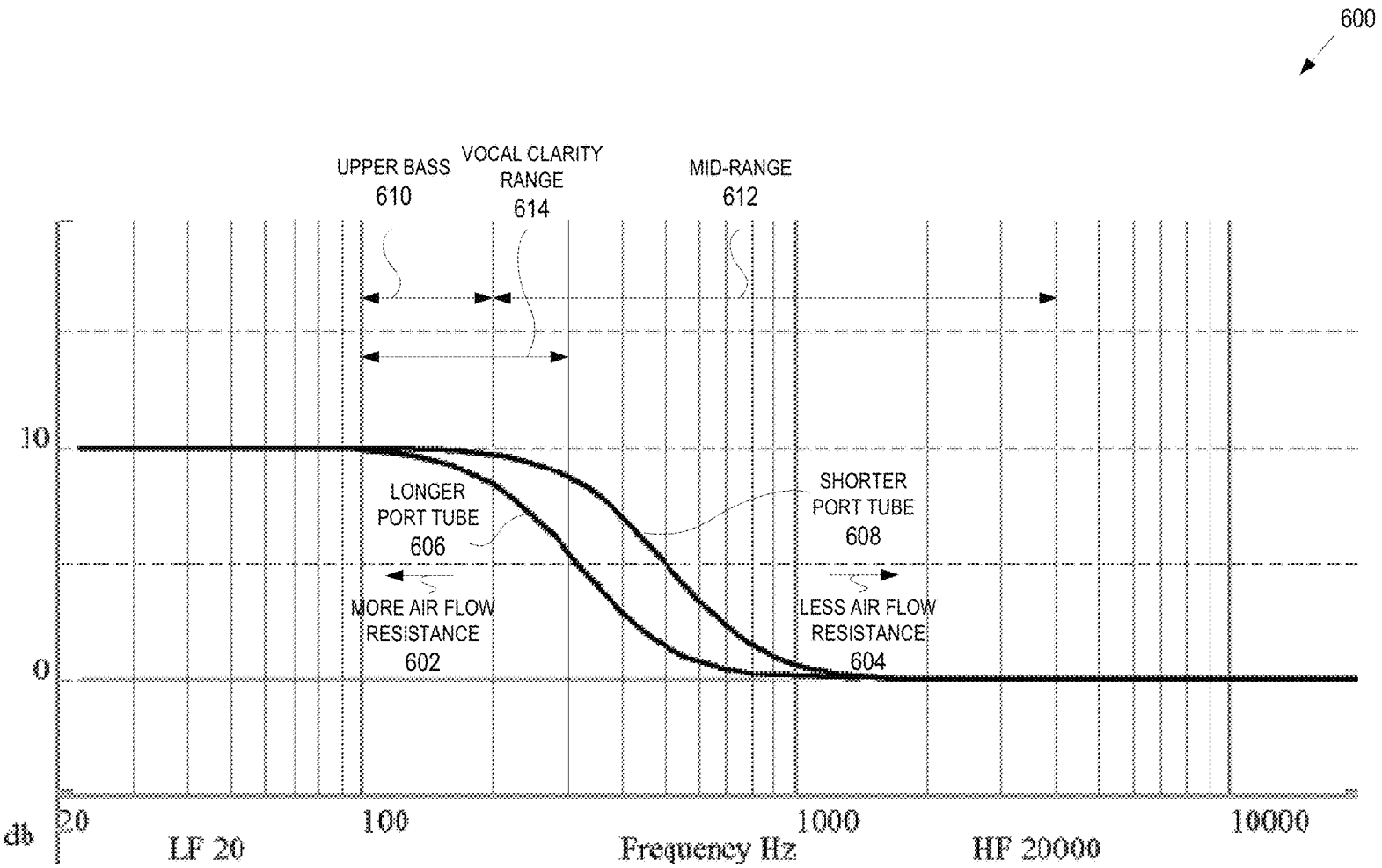
FIG. 6 is a diagram showing sound pressure levels based on varying air flow resistance at a secondary bass port by varying its size according to various embodiments of the present invention.

FIG. 6 is a diagram 600 showing sound pressure levels based on varying air flow resistance at a secondary bass port by varying its size according to various embodiments of the present invention. Diagram 600 shows a sound pressure level (dB) vs. frequency (Hz) plot based on varying air flow resistance at a secondary bass port by varying its size. The plot is illustrative but not exhaustive. The effect of vary air flow resistance at a secondary bass port by varying its size is shown in diagram 600. For example, by applying different air flow resistances via varying the length of secondary bass port 240, 340, different corresponding sound pressure levels within a frequency range in the frequency response can be achieved. In general, the length of secondary bass port 240, 340 can be determined by measuring the distance between third end opening 244C and fourth end opening 244D.

According to a preferred embodiment, secondary bass port 240, 340 is configured for tuning the sound pressure levels in the frequency response. In general, secondary bass port 240, 340 is configured for tuning the sound pressure levels within a frequency range of about 100 Hz to 4 kHz in the frequency response. Specifically, secondary bass port 240, 340 is configured for optimizing the upper bass frequencies (e.g., 100 Hz to 200 Hz) and lower mid-range frequencies (e.g., above 200 Hz to 1.5 kHz). Further, secondary bass port 240, 340 or secondary bass port chamber 242, 342 has a corresponding air flow resistance such that lowering the air flow resistance results in increasing sound pressure levels between about 100 Hz and 300 Hz in the frequency response for worse vocal clarity and increasing the air flow resistance results in decreasing sound pressure levels between about 100 Hz and 300 Hz in the frequency response for better vocal clarity. The lowering or increasing of air flow resistance is due to varying the length of secondary bass port 240, 340.

To further elaborate, plot curve 606 corresponds to a longer port tube (i.e., secondary bass port 240, 340) such as shown in FIG. 3. Plot curve 608 corresponds to a shorter port tube (i.e., secondary bass port 240, 340) such as shown in FIG. 2. As such, increasing the length of secondary bass port 240, 340 corresponds to more air flow resistance 602; hence, shifting a plot curve left on diagram 600. Yet, decreasing the length of secondary bass port 240, 340 corresponds to less air flow resistance 604; hence, shifting a plot curve right on diagram 600. By adjusting or configuring the length of secondary bass port 240, 340, the sound pressure levels can be optimized for a particular frequency range. For example, a plot curve having optimized vocal clarity (i.e., emphasis on vocals in an audio reproduction) may correspond to a secondary bass port 240, 340 with a length for increasing the sound pressure levels within a vocal clarity range 614 (e.g., 100 Hz to 300 Hz) and/or increasing the sound pressure levels within other mid-range frequencies (e.g., above 300 Hz to 1.5 kHz or 4 kHz) in the frequency response of headphone 200, 300. According to some embodiments, the midpoint between the peak and trough of plot curve for optimized vocal clarity is at about 300 Hz. Vocal clarity range 614 may encompass portions of upper bass range 610 (e.g., 100 Hz to 200 Hz) and lower mid-range (e.g., above 200 Hz to 300 Hz) of mid-range 612 (e.g., 200 Hz to 4 kHz).

Notably, plot curve 606 shows an increase (e.g., 6 dB to 10 dB) of the sound pressure levels within vocal clarity range 614 (e.g., 100 Hz to 300 Hz) and an increase (e.g., 0 dB to <6 dB) of the sound pressure levels within the mid-range (e.g., above 300 Hz to 1.5 kHz) in the frequency response of headphone 200, 300. Yet, plot curve 608 shows an increase (e.g., 9 dB to 10 dB) of the sound pressure levels within vocal clarity range 614 (e.g., 100 Hz to 300 Hz) and an increase (e.g., 0 dB to <9 dB) of the sound pressure levels within the mid-range (e.g., above 300 Hz to 1.5 kHz) in the frequency response of headphone 200, 300. As such, plot curve 606 may be deemed to have a better balance of tuning the sound pressure levels in the frequency response for optimized vocal clarity. Accordingly, plot curves 606 and 608 can correspond to any adjustment or configuration to sound pressure levels within a range of frequencies in the frequency response of headphone 200, 300 based on the amount of air flow resistance introduced by varying the length of secondary bass port 240, 340. As noted earlier, the plot is illustrative but not exhaustive. Therefore, the peak of the plot curves can be 20 dB instead of 10 dB as shown in FIG. 6.

Figure 7:
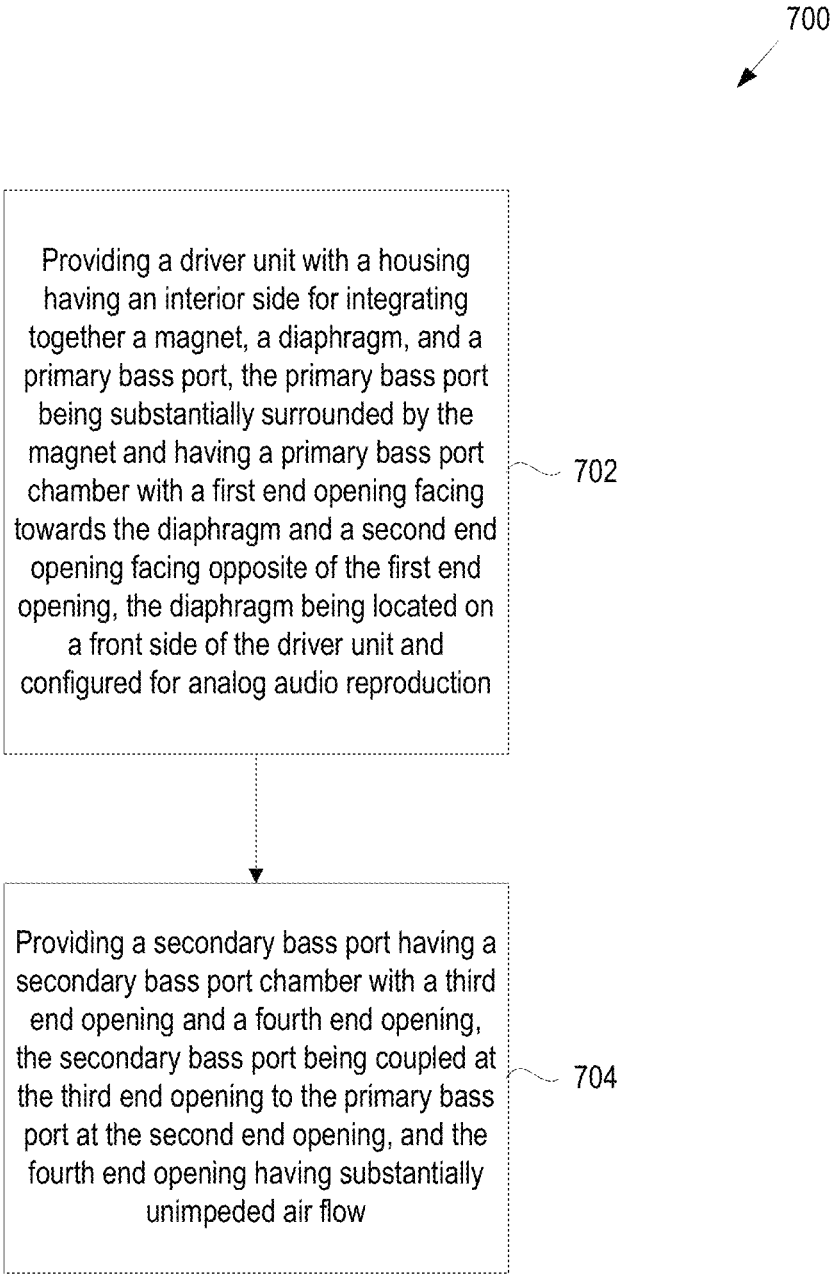
FIG. 7 is a flow diagram for an apparatus with acoustic enhancement according to various embodiments of the present invention.

FIG. 7 is a flow diagram 700 for an apparatus with acoustic enhancement according to various embodiments of the present invention. At step 702, a driver unit is provided with a housing having an interior side for integrating together a magnet, a diaphragm, and a primary bass port, the primary bass port being substantially surrounded by the magnet and having a primary bass port chamber with a first end opening facing towards the diaphragm and a second end opening facing opposite of the first end opening, the diaphragm being located on a front side of the driver unit and configured for analog audio reproduction. At step 704, a secondary bass port is provided having a secondary bass port chamber with a third end opening and a fourth end opening, the secondary bass port being coupled at the third end opening to the primary bass port at the second end opening, and the fourth end opening having substantially unimpeded air flow. Various embodiments of flow diagram 700 can be based according to the specification, including the description, figures, and claims.

The present invention relates to an apparatus with acoustic enhancement. Various embodiments include the apparatus having a secondary bass port with or without an isolating acoustic chamber. For example, the apparatus can be either: 1) a closed-back headphone with a secondary bass port and an isolating acoustic chamber; 2) an open-back headphone with a secondary bass port and no isolating acoustic chamber; or 3) a semi-open back headphone with a secondary bass port and an isolating acoustic chamber. Different combinations between headphone types, secondary bass port, and isolating acoustic chamber are possible. The air flow at end openings (e.g., third end opening 244C, fourth end opening 244D) and/or size (e.g., length, diameter, width, height, etc.) of the secondary bass port 240/340 can be selected/adjusted to achieve a desired sound signature or frequency response for the apparatus. In general, as shown in FIG. 5 for example, increasing the air flow at end openings of the secondary bass port can increase the sound levels of a certain frequency range within the frequency response for the apparatus. In addition, as shown in FIG. 6 for example, adjusting the size of the secondary bass port can shift a plot curve left or right to modulate the sound levels in a certain frequency range within the frequency response for the apparatus.

Advantageously, various embodiments of the present invention provide: 1) the improved efficiency of modifying a headphone sound signature or frequency response; 2) the ability for a manufacturer to incorporate components into the headphone casing without substantially affecting the sound signature or frequency response since they can be separate from or outside the acoustic chamber; 3) the ability to create a smaller casing and headphone; 4) the ability to adjust for better vocal clarity; 5) the ability to enhance bass with a smaller acoustic volume; 6) the ability to compensate for the bass levels that traditional acoustic chambers' achieved through larger sizes/volumes (e.g., acoustic volumes); and/or 7) less tuning due to the isolated acoustic chamber (e.g., isolated from other components such as battery and PCBA).

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. An apparatus with acoustic enhancement, the apparatus having a corresponding frequency response, comprising:

a driver unit with a housing having an interior side for integrating together a magnet, a diaphragm, and a primary bass port, the primary bass port being substantially surrounded by the magnet and having a primary bass port chamber with a first end opening facing towards the diaphragm and a second end opening facing opposite of the first end opening, the diaphragm being located on a front side of the driver unit and configured for analog audio reproduction; and a secondary bass port having a secondary bass port chamber with a third end opening and a fourth end opening, the secondary bass port being coupled at the third end opening to the primary bass port at the second end opening, and the fourth end opening having substantially unimpeded air flow.

2. The apparatus as recited in claim 1, further comprising:

an acoustic chamber configured to prevent ambient noise from substantially mixing with the analog audio reproduction, the acoustic chamber substantially encircling and covering a backside of the driver unit except for where the secondary bass port couples to the primary bass port of the driver, wherein the acoustic chamber and the secondary bass port are configured for collectively tuning the sound pressure levels in the frequency response and the backside of the driver unit corresponds to an exterior side of the housing, the exterior side of the housing being opposite of the interior side of the housing, wherein the second end opening of the primary bass port does not open to the acoustic chamber.

3. The apparatus as recited in claim 2, wherein each chamber has a different pressure during an operational mode.

4. The apparatus as recited in claim 3, wherein the operational mode is when the diaphragm is moving.

5. The apparatus as recited in claim 1, wherein a first air flow resistor is controllable to apply different air flow resistances at the fourth end opening of the secondary bass port.

6. The apparatus as recited in claim 5, wherein a second air flow resistor is configured to apply a fixed air flow resistance at either the second end opening of the primary bass port or third end opening of the secondary bass port.

7. The apparatus as recited in claim 6, wherein the first and second air flow resistors are of a gas permeable construction, the gas permeable construction being selected from the group consisting of paper, cloth, foam, mesh, and felt.

8. The apparatus as recited in claim 1, wherein the secondary bass port is sizable in real time.

9. The apparatus as recited in claim 1, wherein the secondary bass port is configured for tuning the sound pressure levels in the frequency response.

10. The apparatus as recited in claim 9, wherein the secondary bass port is configured for tuning the sound pressure levels within a frequency range of about 100 Hz to 4 kHz in the frequency response.

11. The apparatus as recited in claim 9, wherein the secondary bass port chamber has a corresponding air flow resistance such that lowering the air flow resistance results in increasing sound pressure levels between about 100 Hz and 300 Hz in the frequency response for worse vocal clarity and increasing the air flow resistance results in decreasing sound pressure levels between about 100 Hz and 300 Hz in the frequency response for better vocal clarity.

12. The apparatus as recited in claim 1, wherein the secondary bass port comprises a plurality of sections that divide the secondary bass port chamber into sub-chambers, each sub-chamber having a different cross sectional area.

13. The apparatus as recited in claim 12, wherein at least two of the plurality of sections are constructed from different materials, the material being selected from the group consisting of plastic, ethylene-vinyl acetate (EVA) felt, metal, non-metal, rubber, foam, and sponge.

14. The apparatus as recited in claim 1, wherein the driver unit is a dynamic driver.

15. The apparatus as recited in claim 1, wherein the apparatus is selected from the group consisting of in-ear headphones, on-ear headphones, over-ear headphones, open-back headphones, semi-open back headphones, and closed-back headphones.

16. The apparatus as recited in claim 1, wherein the primary bass port is a substantially straight tube and the secondary bass port is a hollow structure of substantially any shape selected from the group consisting of a straight tube, a winding tube, a straight/winding polygonal cross sectional hollow structure, a straight/winding cylindrical hollow structure, a flare out tube, and any combination of these.

17. The apparatus as recited in claim 1, wherein the fourth end opening does not open to an acoustic chamber.

18. The apparatus as recited in claim 1, wherein the secondary bass port is completely contained within a removable casing end cap.

19. An apparatus with acoustic enhancement, the apparatus having a corresponding frequency response, comprising:

a driver unit with a housing having an interior side for integrating together a magnet, a diaphragm, and a primary bass port, the primary bass port being substantially surrounded by the magnet and having a primary bass port chamber with a first end opening facing towards the diaphragm and a second end opening facing opposite of the first end opening, the diaphragm being located on a front side of the driver unit and configured for analog audio reproduction;

a secondary bass port having a secondary bass port chamber with a third end opening and a fourth end opening, the secondary bass port being coupled at the third end opening to the primary bass port at the second end opening, wherein a first air flow resistor is controllable to apply different air flow resistances at the fourth end opening of the secondary bass port; and a user switch for controlling in real time the first air flow resistor's application of different air flow resistances at the fourth end opening of the secondary bass port, the different air flow resistances being incremental or continuous values.

20. The apparatus as recited in claim 5, wherein the application of different air flow resistances at the fourth end opening of the secondary bass port results in different sound pressure levels within a frequency range of about 20 Hz to 1.5 kHz in the frequency response.

21. An apparatus with acoustic enhancement, the apparatus having a corresponding frequency response, comprising:

means for converting electrical audio input signal to acoustical audio output signal; and means for tuning the sound pressure levels within a frequency range from 100 Hz to 4 kHz in the frequency response, wherein the means for tuning is coupled to the means for converting via a primary bass port of the means for converting.

22. A method for an apparatus with acoustic enhancement, the apparatus having a corresponding frequency response, comprising:

providing a driver unit with a housing having an interior side for integrating together a magnet, a diaphragm, and a primary bass port, the primary bass port being substantially surrounded by the magnet and having a primary bass port chamber with a first end opening facing towards the diaphragm and a second end opening facing opposite of the first end opening, the diaphragm being located on a front side of the driver unit and configured for analog audio reproduction; and providing a secondary bass port having a secondary bass port chamber with a third end opening and a fourth end opening, the secondary bass port being coupled at the third end opening to the primary bass port at the second end opening, and the fourth end opening having substantially unimpeded air flow.

* * * * *